United States Patent [19]

Johnson et al.

[11] 4,072,848

[45] Feb. 7, 1978

[54] ELECTRICAL HEATING CABLE WITH TEMPERATURE SELF-LIMITING HEATING ELEMENTS

[75] Inventors: Ben C. Johnson, San Marcos; J. Scott Thornton, Austin; Donald E. Glowe, Austin; Patrick E. Cassidy, Austin; Robert E. Anderson, San Marcos, all of Tex.

[73] Assignee: Thermon Manufacturing Company

[21] Appl. No.: 714,574

[22] Filed: Aug. 16, 1976

Related U.S. Application Data

[63] Continuation-in-part of Ser. No. 707,648, July 22, 1976.

[51] Int. Cl.[2] ..... H05B 3/56

[52] U.S. Cl. ..... 219/528; 174/52 PE; 219/505; 219/535; 219/541; 219/544; 219/549; 338/22 R; 338/214

[58] Field of Search ..... 219/353, 386, 441, 494, 219/505, 528, 535, 539, 541, 543, 544, 552, 553; 338/22 R, 22 SD, 23, 25, 214; 174/52 PE

[56] References Cited

U.S. PATENT DOCUMENTS

| | | | |
|---|---|---|---|
| 2,719,907 | 10/1955 | Combs | 219/528 |
| 3,341,690 | 9/1967 | Commins | 219/528 |
| 3,375,774 | 4/1968 | Fujimura et al. | 219/441 X |
| 3,551,644 | 12/1970 | Sano et al. | 219/441 |
| 3,748,439 | 7/1973 | Ting et al. | 219/353 |
| 3,757,086 | 9/1973 | Indoe | 219/528 |
| 3,824,328 | 7/1974 | Ting et al. | 174/52 PE |
| 3,959,622 | 5/1976 | Bohdonow | 219/549 |
| 3,976,854 | 8/1976 | Ishikawa et al. | 338/22 R X |
| 3,995,141 | 11/1976 | Vieau et al. | 219/386 |

*Primary Examiner*—Volodymyr Y. Mayewsky
*Attorney, Agent, or Firm*—Pravel, Wilson & Gambrell

[57] ABSTRACT

An electrical heating cable which limits power output once an established temperature limit is reached. The cable includes heating elements in the form of temperature-sensitive variable resistance elements electrically connected in parallel between two supply bases at spaced positions along the length of the buses. The heating elements not only serve to generate heat for heating but also undergo a substantial positive increase in resistivity when the temperature of the cable nears the established temperature limit. The increase in resistivity substantially reduces the heat-generating current in the cable to limit the power output to within established heat limits.

6 Claims, 4 Drawing Figures

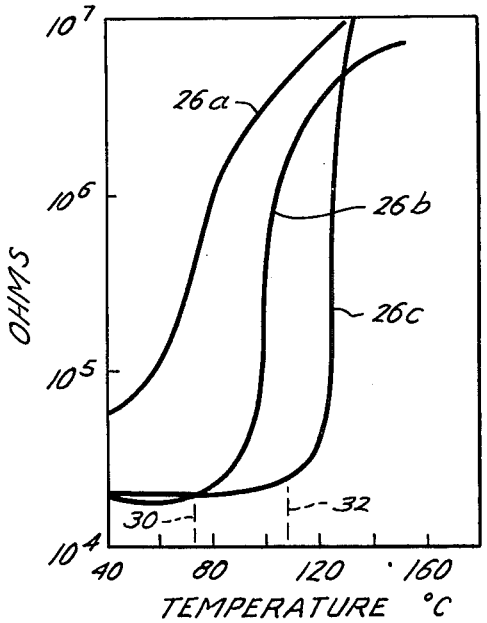
Fig. 1
Fig. 2
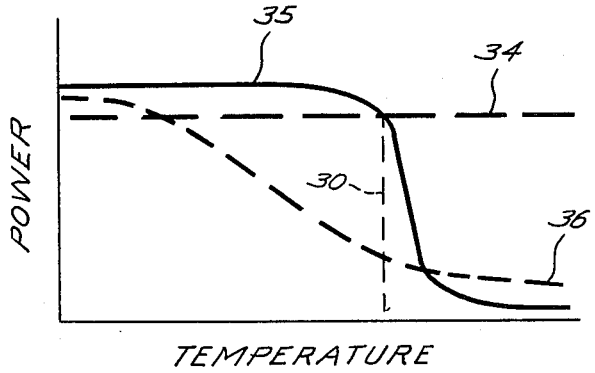

ELECTRICAL HEATING CABLE WITH TEMPERATURE SELF-LIMITING HEATING ELEMENTS

CROSS-REFERENCE TO RELATED APPLICATIONS

The present invention is a continuation-in-part application of United States Patent Application Ser. No. 707,648, filed July 22, 1976, of which applicants are joint inventors and which is assigned to the assignee of the present invention.

BACKGROUND OF THE INVENTION

1. Field of Invention

The present invention relates to electrical heating cables.

2. Description of the Prior Art

Electrical heating cables and tapes, as exemplified by U.S. Pat. Nos. 2,719,902 and 3,757,086, have been used commercially for some time to provide heat to pipes and tanks in cold environments.

In the past, control of the temperature of these cables has been achieved by means of an external thermostat which interrupts the current flow to the cable at a specified temperature limit. These external thermostats, even when carefully installed, could be so located that the pipe or tank temperature was sensed and controlled without regard for the actual temperature of the heating cable. In addition, these thermostats were prone to failure, resulting in thermal run-away when the thermostat failed, degradation of the electrical insulation, and possible destruction of the heating cable.

Another form of heating tape was designed for use without a thermostat and used a polymer substituted for the resistance wire. The polymer was made partially conductive by compounding with small particles of carbon or other conductive material so that heat was formed when current flowed through the partially conductive polymer. However, with this form of tape, the amount of heat produced per unit length was limited. Further, at high working temperatures a loss of heat producing ability occurred with this tape.

SUMMARY OF THE INVENTION

Briefly, the present invention provides a new and improved electrical heating cable which has a temperature self-limiting capability. The electrical heating cable includes first and second electrical conductors or supply buses situated in proximity with each other and insulated from each other by insulation material. The conductors receive operating currrent from a power supply. Heating elements in the form of temperature-sensitive resistance elements are electrically connected in parallel between the electrical conductors at spaced positions along the cable so that current flows through the elements to generate heat when power is applied across the electrical conductors.

The temperature-sensitive material of the heating element has a temperature limit substantially equal to the desired self-limiting temperature of the heating cable and undergoes a substantial increase in temperature coefficient of resistance when this limit is reached, so that the resistance of such heating element substantially increases. The current flowing substantially decreases in response to the increased resistance, limiting power output from the cable to thereby prevent overheating of the heating cable.

BRIEF DESCRIPTION OF THE DRAWINGS

FIG. 1 is a graphical presentation of resistance-temperature characteristics of materials used in the electrical heating cable of the present invention;

FIG. 2 is a graphical illustration of the power-temperature characteristics of electrical heating cables;

DESCRIPTION OF THE PREFERRED EMBODIMENT

Figure 3:
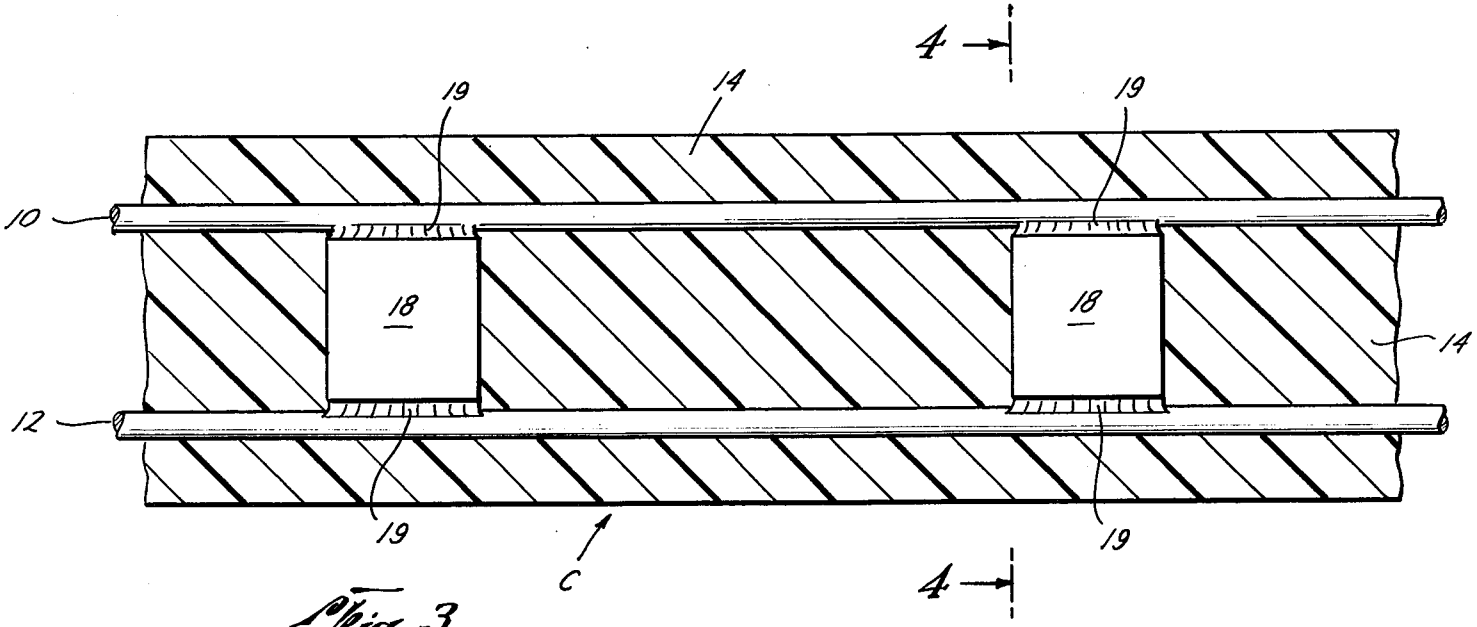
FIG. 3 is a cross-sectional view of an electrical heating cable of the present invention.
Figure 4:
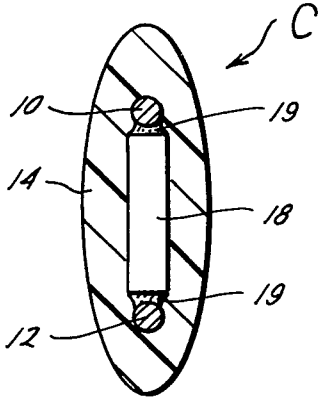
FIG. 4 is a cross-sectional view taken along the lines 4—4 of FIG. 3.

In the drawings, the letter C (FIGS. 3 and 4) designates generally a temperature self-limiting electrical heating cable or tape of the present invention which may be used to provide heat to pipes, tanks and the like in cold environments and elsewhere. The cable C provides heat as a result of the power consumed when electric current flows therethrough, and is placed in proximity to the object to be heated.

The electrical heating cable C includes two elongate electrical conductors or supply buses 10 and 12 situated in proximity with each other along the length of the cable C. The conductors 10 and 12 are insulated from each other by portions of a suitable primary insulating material 14 mounted therebetween. The conductors 10 and 12 are also enclosed within the insulating material 14 (FIG. 4) which serves as an insulative or protective covering.

A plurality of heating elements 18 capable of producing heat when current flows therethrough are electrically connected in parallel between the electrical conductors 10 and 12 along their length in a manner to be set forth. The heating elements 18 are formed according to the present invention from a temperature-sensitive variable resistance material of a type to be set forth. It has been found that heating elements of such a temperature-sensitive material may serve as heating elements while also performing temperature self-limiting functions.

Electric power is applied to the conductors 10 and 12 from a suitable power supply to cause current to flow through the temperature-sensitive variable resistance heating elements 18 connected in a parallel electrical circuit connection between conductors 10 and 12. The electrical conductors 10 and 12 are of copper or other suitable conductive metal, which are insulated from each other by the primary insulation material 14 which completely surrounds such conductors except at intervals between same formed for connection of the heating elements 18.

The insulation 14 is a suitable rubber or thermoplastic insulating material, and is removed at the specified spaced intervals to form pockets or gaps in the insulation material along the length of the cable C where the heating elements 18 are mounted. The spacing between heating elements 18 along the cable C may vary, for example from less than 1 to approximately 24 inches, depending upon the amount of heat to be generated and the type of use for which the electrical heating cable C is intended.

The heating elements 18 are a plurality of discrete elements or chips which are mounted in the gaps or pockets in insulation material 14 in electrical contact with electrical conductors 10 and 12 of the cable C. The heating elements 18 are first electroded with ohmic contacts 19 before attachment to the conductors 10 and 12 to provide direct electrical contact therewith. The ohmic contacts on the chips 18 are formed by conventional processes, such as vapor deposition, flame-spraying and the like. The heating elements 18 may alternatively be soldered to the conductors 10 and 12 by thermosetting, hot weld, or ultrasonic soldering techniques, if desired.

If desired, an electrically conductive thermosetting plastic material, such as carbon-filled epoxy or conductive solder, may be applied between the heating elements 18 and the conductors 10 and 12.

Further, if desired, an outer enclosing insulation jacket or sleeve, not shown in the drawings, may be placed around the cable C as an outer protective covering for conductors 10 and 12, insulation 14 and heating elements 18 to provide external insulation for the cable C. It should be understood, however, that such an outer enclosing insulation jacket is not required for operation of the cable C.

The temperature-sensitive variable resistance material of the heating elements 18 may be any material characterized by a large positive increase in temperature coefficient of resistivity or anomaly in the vicinity of its ferroelectric-paraelectric transition temperature, which is commonly referred to as the Curie point. The Curie point of the material to be used is chosen to be approximately equal to the desired self-limiting temperature of the electrical heating cable C. In this type material, the electrical resistance prior to reaching the Curie point is typically small in comparison to the resistance of the material in the vicinity of the Curie point. For example, a group of curves 26*a*, 26*b* and 26*c* of FIG. 1 indicate resistivity per unit area as a function of temperature for materials used as the heating elements 18 of the present invention. Lines 30 and 32 indicate Curie points for the materials illustrated in curves 26*b* and 26*c*, respectively.

As is evident, the variable resistance material heating elements 18 have a low resistance within the temperature range below the Curie points of the materials. The resistance of the variable resistance materials 18, however, rapidly increases by several orders of magnitude within a relatively small increase in temperature (5°–10° C.) in the vicinity of the Curie points.

One suitable temperature-sensitive variable resistance materials for use in the present invention are those materials used in semiconductor elements known as thermistors. An N-type semiconductor material is formed by doping barium titanate or a related perovskite material with lanthanum ions or other element ions of higher valence than barium or titanium, as described in more detail in U.S. Pat. Nos. 3,416,957 and 3,351,568.

By doping barium titanate with lanthanum ions, the room temperature resistance value of the resulting semiconductor material is lowered from the very high resistance value typical of barium titanate material to a resistance in the same order or magnitude required for heating elements, thereby also shifting the Curie point to a temperature approximately equal to the desired self-limiting temperature of the electrical heating cable. By varying the amount and valence of the impurity ions in the barium titanate material, the Curie point, and hence the desired self-limiting temperature, may be varied. The overall resistance of the doped semiconductor material heating elements 18 depends on the physical dimensions of the material as well as the concentration of impurity ions. For example, a 7mm × 3mm × 1.5mm chip of barium titanate material doped with a given concentration of lanthanum ions was found to have a resistance of 300 ohms at 25° C., a Curie point of 75° C., and a resistance of 30,000 ohms at 80° C.

In the past, electrical heating cables having current flowing only through a heat-generating high resistance material continued to consume substantially the same amount of power for a given voltage over the entire temperature range as shown by the line 34 in FIG. 2, past the desired self-limiting temperature necessary to prevent cable damage due to overheating. Electrical heating cables using partially conductive polymer as heat-generating material exhibited a marked decrease in power output before the desired temperature limit was approached, as shown by line 36 in FIG. 2.

By connecting the temperature-sensitive variable resistance materials 18 in parallel between the conductors 10 and 12 as heating elements according to the present invention, however, the power converted into heat, as indicated by the line 35 in FIG. 2, is reduced substantially when the temperature approaches the Curie point 30 of the heating elements 18. In this temperature range, the resistivity of the heating elements 18 substantially increases the overall resistance in the cable C, thereby substantially reducing the current flowing therethrough and reducing heat.

Further, by using the variable resistance, temperature-sensitive materials as the heating elements themselves according to the present invention, separate heating elements and temperature control element chips are no longer necessary, simplifying cable construction and reducing manufacturing and assembly costs for the heating cable C according to the present invention.

It has been found that the heating elements 18 of barium titanate having a Curie temperature of 75° C. and the dimensions and characteristics previously described, when connected between the conductors 10 and 12 in the manner described above, generate the required amounts of heat. However, when the established temperature limited is neared, the resistance of the heating elements 18 substantially increases, to substantially reduce the current flow and power consumed by the electrical heating cable C in the region of the Curie point. Reduction of the current flow further causes the temperature of the cable C to stabilize at a temperature below the Curie point. It has also been found that the conductors 10 and 12 assist the temperature-limiting heating elements 18 in temperature limiting in that these metallic conductors assist in heat dissipation.

The foregoing disclosure and description of the invention are illustrative and explanatory thereof, and various changes in the size, shape and materials, as well as in the details of the illustrated construction may be made without departing from the spirit of the invention.

We claim:

1. A temperature self-limiting electrical heating cable or tape to provide heat to pipes, tanks and the like, comprising:

(a) first conductor means and second conductor means extending in proximity to each other along the length of the cable for conveying electrical current;

(b) insulating means, comprising:

(1) insulating material mounted between said first and second conductor means along the length of the cable for insulating said first and second conductor means from each other;

(2) said insulating material mounted between said first and second conductor means having portions thereof removed at spaced intervals thereof to form pockets;

(3) said pockets being spaced from each other along the length of the cable in accordance with the heat to be generated by the cable; and (4) insulating material enclosing said first and second conductor means and serving as a protective covering therefor; and (c) heating means comprising a plurality of chips of variable resistance heating material mounted in said pockets in said insulating material and being electrically connected between said first and second conductor means for producing heat when current flows therethrough, said variable resistance chips substantially increasing in resistance when a temperature limit is reached to reduce the current flowing through said heating means and control the heat output of the cable.

2. The electrical heating cable of claim 1, wherein said heating means comprises:

variable resistance heating chips electrically connected in parallel between said first and second conductor means.

3. The electrical heating cable of claim 1, wherein each of said plurality of chips comprises:

doped barium titanate.

4. The electrical heating cable of claim 1, wherein each of said plurality of chips comprises:

barium titanate doped with ions to obtain a Curie point substantially equal to the desired temperature limit of the cable.

5. The electrical heating cable of claim 1, further including:

means for enclosing said variable resistance means and said conductor means.

6. The electrical heating cable of claim 1, wherein said plurality of variable resistance elements are mounted in ohmic contact with said conductor means.

* * * * *